US008394748B2

(12) United States Patent
Hishinuma et al.

(10) Patent No.: US 8,394,748 B2
(45) Date of Patent: Mar. 12, 2013

(54) GREASE COMPOSITION AND PROCESS FOR PRODUCING THE SAME

(75) Inventors: Takeshi Hishinuma, Ibaraki (JP); Toshio Nitta, Ibaraki (JP); Tatsuya Hashimoto, Ibaraki (JP); Takao Kanno, Ibaraki (JP)

(73) Assignee: NOK Kluber Co., Ltd., Tokyo (JP)

( * ) Notice: Subject to any disclaimer, the term of this patent is extended or adjusted under 35 U.S.C. 154(b) by 285 days.

(21) Appl. No.: 12/671,276

(22) PCT Filed: Jul. 15, 2008

(86) PCT No.: PCT/JP2008/062729

§ 371 (c)(1),
(2), (4) Date: Jan. 29, 2010

(87) PCT Pub. No.: WO2009/016956

PCT Pub. Date: Feb. 5, 2009

(65) Prior Publication Data

US 2010/0210494 A1 Aug. 19, 2010

(30) Foreign Application Priority Data

Jul. 31, 2007 (JP) ..... 2007-199089

(51) Int. Cl.
*C10M 169/04* (2006.01)
*C10M 107/38* (2006.01)

(52) U.S. Cl. ..... 508/582; 508/588

(58) Field of Classification Search ..... 508/588, 508/582

See application file for complete search history.

(56) References Cited

U.S. PATENT DOCUMENTS

| | | | | |
|---|---|---|---|---|
| 4,472,290 | A * | 9/1984 | Caporiccio et al. | 508/181 |
| 2003/0069144 | A1 | 4/2003 | Iso | |
| 2004/0266632 | A1 | 12/2004 | Iso | |
| 2005/0261141 | A1 | 11/2005 | Iso et al. | |

(Continued)

FOREIGN PATENT DOCUMENTS

| | | |
|---|---|---|
| JP | 07-268370 | 10/1995 |
| JP | 2003-096480 | 4/2003 |

(Continued)

OTHER PUBLICATIONS

International Search Report from corresponding PCT application No. PCT/JP2008/062729 dated Oct. 7, 2008, 4 pages.

(Continued)

*Primary Examiner* — Jim Goloboy
(74) *Attorney, Agent, or Firm* — Brinks Hofer Gilson & Lione

(57) ABSTRACT

A grease composition, which comprises a mixture of mutually incompatible thickener-containing non-fluorine-based base oil and thickener-containing fluorine-based base oil, the base oils being in a morphological structure, where one of the base oils is homogeneously dispersed in a particulate state in the other base oil, can be produced by kneading the mixture through a three-roll mill at least twice. By forming a morphological structure, one of the mutually incompatible non-fluorine-based base oil and fluorine-based base oil is homogeneously dispersed in a particulate state in the other base oil, that is, by forming a microscopically dispersed state, the following effects can be obtained: (1) less oil separation (smaller degree of oil separation) at elevated temperatures, (2) distinguished shearing stability, (3) low and stable friction coefficient, and (4) less abrasion.

4 Claims, 1 Drawing Sheet

U.S. PATENT DOCUMENTS

| | | | |
|---|---|---|---|
| 2006/0058203 | A1 | 3/2006 | Laufer et al. |
| 2006/0252654 | A1 | 11/2006 | Iso et al. |
| 2006/0252655 | A1 | 11/2006 | Iso et al. |

FOREIGN PATENT DOCUMENTS

| | | | |
|---|---|---|---|
| JP | 2003-239997 | | 8/2003 |
| JP | 2004-028326 | | 1/2004 |
| JP | 2004-124050 | | 4/2004 |
| JP | 2004-190688 | | 7/2004 |
| JP | 2004-323541 | | 11/2004 |
| JP | 2006-070263 | | 3/2006 |
| JP | 2006-182923 | | 7/2006 |
| JP | 2006182923 | A * | 7/2006 |

OTHER PUBLICATIONS

English Translation of International Preliminary Report on Patentability (Chapter I) and Written Opinion from corresponding PCT application No. PCT/JP2008/062729 dated Mar. 4, 2010, 8 pages.

* cited by examiner

GREASE COMPOSITION AND PROCESS FOR PRODUCING THE SAME

RELATED APPLICATION

This application is a 35 U.S.C. §371 national phase filing of International Patent Application No. PCT/JP2008/062729, filed Jul. 15, 2008, through which and to which priority is claimed under 35 U.S.C. §119 to Japanese Patent Application No. 2007-199089, filed Jul. 31, 2007.

TECHNICAL FIELD

The present invention relates to a grease composition and a process for producing the same, and more particularly to a grease composition, which comprises two kinds of thickener-containing base oils, the base oils being incompatible with each other and being in homogeneous dispersion, and a process for producing the same.

BACKGROUND ART

The conventional fluorine-based grease comprises perfluoropolyether as a base oil, a homopolymer [PTFE] of tetrafluoroethylene [TFE], a copolymer [FEP] of TFE with hexafluoropropylene, a copolymer [PFA] of TFE with perfluoroalkylvinylether, a copolymer [ETFE] of TFE with ethylene, etc. as a thickener, and a small proportion of various additives such as a rust preventive, etc. and is used under strict conditions requiring a low-temperature resistance, a high-temperature durability, an oxidation stability, a chemical resistance, etc.

However, the base oil and the thickener are both fluorine-containing polymers, and thus involve such problems as a high cost, less compatibility with materials to be lubricated such as resins, metals, rubber, etc., or failure to form necessary oil films for lubrication under the conditions such as high load, giving rise to abrasion, or making the friction coefficient so high that the torque transmission efficiency is lowered and the conventional fluorine-based grease has such problem as deterioration of the rust prevention and corrosion resistance.

To solve the problems, it has been so far proposed to use a mixture of fluorine-based grease with a non-fluorine-based grease, as is given in, for example, Patent Document 1, where the mixture is a grease comprising hydrogenated mineral oil and/or synthetic lubricating oil, fluoropolyether oil, and an organic or inorganic thickener in a ratio by weight of lubricating oil+fluoropolyether oil:thickener=97:3~80:20, and a ratio by weight of lubricating oil:fluoropolyether oil=95:5~60:40.

Patent Document 1: JP-A-7-268370

For the mixing to prepare the grease from such a base oil mixture, it is recommended to use a homogenizer such as Manto Galvin type homogenizer or a three-cylinder homogenizer (which can be presumed to be a three-partitioned cylinder block type homogenizer), while it is preferable for better homogeneity to make run number of the homogenizer treatment 2 or 3 times as large as that for the ordinary non-fluorine-based grease. However, as will be given in results of the following Comparative Examples, it is difficult to obtain a homogeneous grease mixture, even if the run number of the mixing treatment by the homogenizer is increased.

Patent Documents 2 and 3, both of which are filed by the present applicant, disclose a process for producing a lubricating grease composition comprising a non-fluorine-based grease and a fluorine-based grease by thorough kneading through three rolls or a high pressure homogenizer, where the three rolls and the high pressure homogenizers are regarded as equivalent kneading means, but no mention is made therein as to the run number of kneading at all.

Patent Document 2: JP-A-2003-96480

Patent Document 3: JP-A-2006-182923

Such grease mixture is less expensive than the single fluorine-based grease, and also has a distinguished abrasion resistance to the mating materials, but as a result of the mixing proportion of the fluorine-based base oil for forming the grease is limited from the viewpoint of its compatibility, the characteristic of the fluorine-based grease, that is, a good heat resistance, cannot be fully demonstrated. Furthermore, the proposed grease mixture has still such problems that any index of homogeneously dispersion of mutually incompatible base oils themselves is not shown therein and the individual base oils of the grease may be sometimes separated from each other, or the grease may be rapidly softened when exposed to a shearing force, depending on the degree of dispersion.

DISCLOSURE OF THE INVENTION

Problem to be Solved by the Invention

The object of the present invention is to provide a grease composition, which comprises a thickener-containing non-fluorine-based base oil and a thickener-containing fluorine-containing base oil, the base oils being in homogeneous dispersion, and a process for producing the same.

Means for Solving the Problem

The object of the present invention can be attained by a grease composition, which comprises a mixture of mutually incompatible thickener-containing non-fluorine-based base oil and thickener containing fluorine-based base oil, the base oils being in a morphological structure where one of the base oils is homogeneously dispersed in a particulate state in the other base oil. The present grease composition can be produced, for example, by kneading a mixture of mutually incompatible thickener-containing non-fluorine-based base oil and thickener-containing fluorine-based base oil through a three-roll mill at least twice.

Effect of the Invention

By forming a morphological structure, where one of mutually incompatible thickener-containing non-fluorine-based base oil and thickener-containing fluorine-based base oil is homogeneously dispersed in a particulate state in the other base oil, that is, by forming a microscopically dispersed state, the following effects can be obtained (1) Less oil separation (low degree of oil separation) at elevated temperatures
(2) Distinguished shearing stability
(3) Low and stable friction coefficient
(4) Less abrasion.

As a result, the following practical effects can be obtained (a) No reduction of base oil even if used at elevated temperatures for a long time
(b) No occurrence of grease softening
(c) Improved reliability of machinery owing to low and stable friction coefficient
(d) Prolonged life of machinery owing to less abrasion.

BRIEF DESCRIPTION OF DRAWINGS

FIG. 1 600-times-magnified microscopic picture of grease composition obtained in Example 7

FIG. 2 600-times-magnified microscopic picture of grease composition obtained in Comparative Example 1

BEST MODES FOR CARRYING OUT THE INVENTION

Figure 1:
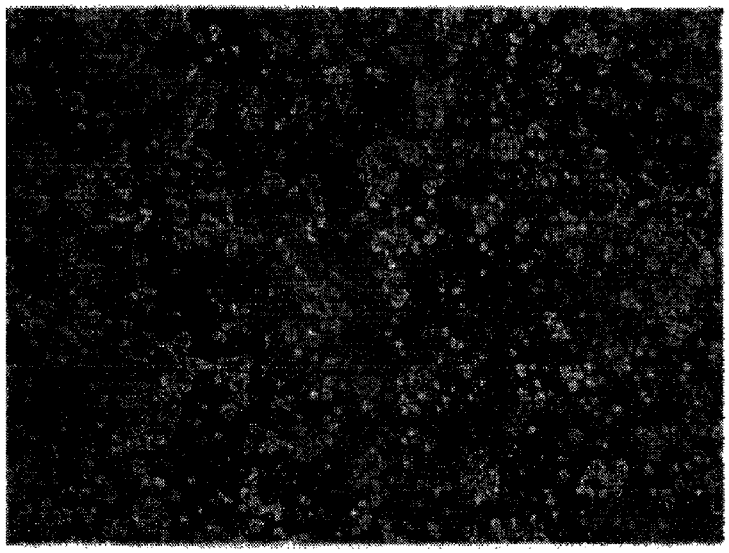

Mutually incompatibility between the thickener-containing non-fluorine-based base oil and the thickener-containing fluorine-based base oil means an incapability of forming a homogeneous grease composition by simple mixing of these two base oils.

The thickener-containing non-fluorine-based base oil is a base grease obtained by mixing a non-fluorine-based base oil with a ordinary thickener for non-fluorine-based base oil.

The non-fluorine-based base oil for use in the present invention includes at least one of, for example, synthetic hydrocarbon oils such as poly-α-olefin, ethylene-α-olefine oligomer, polybutene or hydrogenated oil thereof, alkylbenzene, alkylnaphthalene, etc.; ether-based synthetic oils such as polyalkylene glycol, polyphenyl ether, alkylsubstituted diphenyl ether, etc.; ester-based synthetic oils such as trimellitic acid ester, pyromellitic acid ester, neopentyl glycol ester, trimethylolpropane ester, pentaerythritol ester, dipentaerythritol ester, etc.; synthetic oils such as polyol ester, aromatic polybasic carboxylic acid ester, aliphatic dibasic acid ester, phosphoric acid ester, phosphorous acid ester, carbonic acid ester, etc.; and paraffinic mineral oil, naphthenic mineral oil or purified mineral oils thereof, etc. The base oil having a kinematic viscosity at 40° C. (according to JIS K2283 corresponding to ASTM D445-86) of about 2 to about 1,000 $mm^2$/sec., preferably about 10 to about 500 $mm^2$/sec., can be generally used.

The thickener to be mixed with the non-fluorine-based base oil includes, for example, metallic soaps or metallic complex soaps such as lithium soap, sodium soap, potassium soap, calcium soap, aluminum soap, barium soap, etc.; urea-based compounds such as aliphatic, alcyclic or aromatic diurea, triurea, tetraurea, polyurea, etc.; and inorganic thickeners such as bentonite, silica, etc., where at least one of these thickeners can be used in a proportion of about 5 to about 50 vol. %, preferably about 7 to about 40 vol. % in the base grease.

The thickener-containing fluorine-based base oil is a base grease prepared by mixing a fluorine-based base oil with a ordinary thickener for fluorine-based base oil.

The fluorine-based base oil having a kinematic viscosity at 40° C. (according to JIS K2283) of about 10 to about 1,500 $mm^2$/sec., preferably about 20 to about 500 $mm^2$/sec., can be generally used, and more particularly the base oil represented by the following general formula can be used:

$$RfO(CF_2O)_x(C_2F_4O)_y(C_3F_6O)_zRf$$

Specifically, those represented by the following general formulae (1)-(4) can be used, and furthermore the one represented by the following general formula (5) can be also used, where Rf is perfluoro lower alkyl groups having 1-5 carbon atoms, preferably 1-3 carbon atoms, such as perfluoromethyl group, perfluoroethyl group, perfluoropropyl group, etc.

$$RfO(CF_2CF_2O)_m(CF_2O)_nRf \quad (1)$$

where m+n=3-200, m:n=10-90:90-10, and the $CF_2CF_2O$ group and the $CF_2O$ group are bonded to the main chain at random, and which can be obtained by completely fluorinating the precursor formed by photooxidation polymerization of tetrafluoroethylene.

$$RfO[CF(CF_3)CF_2O)]_m(CF_2O)_nRf \quad (2)$$

where m+n=3-200, m:n=10-90:90-10, and the $CF(CF_3)CF_2O$ group and the $CF_2O$ group are bonded to the main chain at random, and which can be obtained by completely fluorinating the precursor formed by photooxidation polymerization of hexafluoropropylene.

$$RfO[CF(CF_3)CF_2O]_p(CF_2CF_2O)_q(CF_2O)_rRf \quad (3)$$

where p+q+r=3-200, q and r maybe zero, (q+r)/p=0-2, and the $CF(CF_3)CF_2O$ group, the $CF_2CF_2O$ group, and the $CF_2O$ group are bonded to the main chain at random, and which can be obtained by completely fluorinating the precursor formed by photooxidation polymerization of hexafluoropropylene and tetrafluoroethylene.

$$RfO[CF(CF_3)CF_2O]_s(CF_2CF_2O)_tRf \quad (4)$$

where s+t=2-200, t maybe zero, t/s=0-2, and the $CF(CF_3)CF_2O$ group and the $CF_2CF_2O$ group are bonded to the main chain at random, and which can be obtained by completely fluorinating the precursor formed by photooxidation polymerization of hexafluoropropylene and tetrafluoroethylene, or by subjecting hexafluoropropylene oxide or tetrafluoroethylene oxide to anionic polymerization in the presence of a cesium fluoride catalyst, and then treating the resulting acid fluoride compound having a terminal $CF(CF_3)COF$ group with a fluorine gas.

$$F(CF_2CF_2CF_2O)_{2\text{-}100}C_2F_5 \quad (5)$$

which can be obtained by subjecting 2,2,3,3-tetrafluorooxetane to anionic polymerization in the presence of a cesium fluoride catalyst, and then treating the resulting fluorine-containing polyether $(CH_2CF_2CF_2O)_n$ with a fluorine gas at about 160° to about 300° C. under ultraviolet irradiation.

The thickener for mixing into the fluorine-based base oil generally includes fluororesins, and preferably polytetrafluoroethylene [PTFE] resin powder, tetrafluoroethylene-hexafluoropropene copolymer [FEP] powder, perfluoroalkylene resin powder, etc., and can be used in a proportion of about 5 to about 50 vol. %, preferably about 10 to about 40 vol. %, in the base grease.

Polytetrafluoroethylene having a number average molecular weight Mn of about 1,000 to about 1,000,000 can be prepared by emulsion polymerization, suspension polymerization, solution polymerization, etc. of tetrafluoroethylene, followed by thermal decomposition, electron been irradiation decomposition, physical pulverization, etc. thereof, thereby reducing the number average molecular weight to the above-mentioned range. Tetrafluoroethylene-hexafluoropropene copolymer can be prepared by conducting polymerization reaction of tetrafluoroethylene and hexafluoromethylene, and successive molecular weight reduction in the same manner as in the case of polytetrafluoroethylene, thereby reducing the number average molecular weight to the of about 1,000 to about 600,000. Control of the molecular weight can be also carried out by using a chain transfer agent at the time of copolymerization reaction.

In connection to the thickeners each contained in the non-fluorine-based base oil and the fluorine-containing base oil for forming greases, the average particle size (an average of measurements by an optical microscope) of particulate base oil serving as a dispersed phase is preferably set at 30 μm or less, or for establishing the morphological structure, as will be described in detail later, the practical average particle size is less than 30 μm, preferably 0.1-20 μm. When the average particle size of the thickener-containing base oil serving as a dispersed phase exceeds 30 μm, the base oil particles will be deteriorated in the normal preservation state of a grease composition, failing to maintain the homogeneously dispersed state between the base oil particles and also failing to improve the heat resistance of non-fluorine-based grease and the lubricability of fluorine-based grease. When exposed to a shearing force, the grease composition will be softened, failing to maintain the grease state, and furthermore failing to supply the grease to contact surfaces, thereby increasing the friction coefficient and abrasion.

Thickeners can be used in a proportion of 10-50 vol. % in total in the grease composition. The proportion of thickeners in total will be described in detail below, referring to a mixing proportion between the non-fluorine-based oil and the fluorine-based base oil, each containing the thickener.

For homogeneously dispersing the non-fluorine-based base oil and the fluorine-based oil, each containing the thickener, the volumic ratio of these two base oils and the proportion of thickeners in total are important. For example, in the case of a proportion of thickeners in total of 10 vol. %, the non-fluorine-based base oil must be in such a volumic ratio as to exclude 40-55 vol. %, and the fluorine-based base oil must be in such a ratio as to exclude 60-45 vol. %. That is, in the case that the non-fluorine-based base oil is in a volumic ratio of less than 40 vol. %, a morphological structure can be established, where the non-fluorine-based base oil can serve nuclei as dispersed phase, and the fluorine-based grease can serve a dispersion medium in a continuous phase. In the case that the fluorine-based base oil is in a volumic ratio of less than 45 vol. %, such a morphological structure can be established, where the fluorine-containing base oil can serve nuclei as dispersed phase, and the non-fluorine-based base oil can serve a dispersion medium in a continuous phase.

Within the above-mentioned excluded ranges of volumic ratios, on the other hand, these two base oils fall into substantially equal volumic ratios, failing to establish the morphological structure. In other words, these two base oils fail to give a homogeneous mixture. It has been found that this tendency can be maintained up to the proportion of thickeners in total of 30 vol. %, and when the proportion of thickeners in total exceeds 30 vol. %, the morphological structure can be established, irrespective of any volumic ratio of base oils.

Thus, in the case of a mixture of 5-95 vol. % of the thickener-containing non-fluorine-based base oil and 95-5 vol. % of the thickener-containing fluorine-containing base oil, the proportion of thickeners in total is set at more than 30 vol. % and not more than 50 vol. %, preferably 31-45 vol. %, in the grease composition. When the thickener-containing non-fluorine-based base oil is in a range of 5-40 vol. %, or 55-95 vol. % in the grease composition, and the thickener-containing fluorine-based base oil is in a range of 95-60 vol. %, or 45-5 vol. % in the grease composition, the proportion of thickeners in total is set at 10-30 vol. %, preferably 15-25 vol. %, in the grease composition.

When the proportion of thickeners in total is less than 10 vol. %, the grease will be softened and leaked from the machinery, irrespective of whether the morphological structure is established or not, making the grease unpractical, whereas when the proportion of thickeners in total is exceeds 50 vol. %, the grease will be hardened, resulting in rotation failure of, for example, ball-and-roller bearings, etc., that is, making the grease unpractical. Furthermore, the non-fluorine-based base oil and the fluorine-based base oil need mixing with the appropriate thickeners corresponding base oil, respectively, and when the thickener is admixed with only one of the base oils, no homogeneous dispersion can be attained between the base oils, resulting in separation one of base oils from the grease in the course of time, and when the grease is exposed to a shearing force, softening will occur abruptly, resulting in failure to maintain the grease state. When the thickener-containing non-fluorine-based base oil is in a ratio of less than 5 vol. %, the abrasion resistance will be deteriorated, whereas when the thickener-containing fluorine-based base oil is in a ratio of less than 5 vol. %, the heat resistance will be also deteriorated.

The present grease composition can further contain additives so far used in the conventional lubricants such as an antioxidant, a rust preventive, a corrosion inhibitor, an extreme pressure agent, an oiling agent, a solid lubricant, etc. The antioxidant includes, for example, a phenolic antioxidant such as 2,6-t-butyl-4-methylphenol, 4,4'-methylenebis(2,6-di-t-butylphenol), etc.; an amine-based antioxidant such as alkyldiphenyl amine having an alkyl group of $C_4$-$C_{20}$, triphenylamine, phenyl-α-naphthylamine, alkylated phenyl-α-naphthylamine, phenothiazine, alkylated phenothiazine, etc.; a phosphoric acid-based antioxidant; and a sulfur-based antioxidant.

The rust preventive includes, for example, fatty acid, fatty acid metal salt, fatty acid amine, alkylsulfonic acid metal salt, alkylsulfonic acid amine salt, oxidized paraffin, polyoxyethylene alkyl ether, etc., and the corrosion inhibitor includes, for example, benzotriazole, benzoimidazole, thiadiazole, etc.

The extreme pressure agent includes, for example, a phosphorus-based compound such as phosphoric acid ester, phosphorous acid ester, phosphoric acid ester amine salt, etc.; a sulfur-based compound such as sulfide, disulfide, etc.; a sulfur-based compound metal salt such as dialkyldithiophosphoric acid metal salt, dialkyldithiocarbamic acid metal salt, etc.; and a chlorine-based compound such as chlorinated paraffin, chlorinated diphenyl, etc.

The oiling agent includes, for example, fatty acid, or its ester; higher alcohol, polyhydric alcohol, or their esters; aliphatic ester, aliphatic amine, fatty acid monoglyceride, montan wax, amide-based wax, etc. The another solid lubricant includes molybdenum disulfide, graphite, boron nitride, silane nitride, melamine cyanurate, etc. The another solid lubricant having an average primary particle size of not more than 30 μm, preferably 0.1-20 μm, can be used.

The process for producing the present grease composition includes the following methods:

(1) A soap-based, or urea-based, or the like thickener is added to the non-fluorine-based base oil, followed by kneading through a three-roll mill or a high pressure homogenizer, preferably by conducting the three-roll mill treatment twice, thereby forming a non-fluorine-based grease, and separately mixing the fluorine-based base oil with fluororesin in a mixing kettle, followed by kneading through a three-roll mill or a high pressure homogenizer, preferably by conducting the three-roll mill treatment twice, thereby forming a fluorine-based grease. These two greases are mixed together in a mixing kettle, followed by kneading through the three-roll mill at least twice, thereby forming a grease composition. In the three-roll mill treatment, roll clamping pressure is set at about 0.2 to about 7 MPa.

(2) The non-fluorine-based grease as formed above is mixed with the fluorine-based base oil and fluororesin in a mixing kettle, followed by kneading through a three-roll mill at least twice under roll clamping pressure of e.g. 10 kgf/cm$^2$ (=0.98 MPa), thereby forming a grease composition. In the three-roll mill treatment, the roll clamping pressure is set at about 0.2 to about 7 MPa.

The three-roll mill for use in the kneading is generally of oil-hydraulic type. Antioxidant and other various additives can be added at the time of forming at least one of the thickener-containing non-fluorine-based base oil and the thickener-containing fluorine-based base oil, or at the time of mixing these two thickener-containing base oils in a mixing kettle.

The grease composition thus prepared comprises a mixture of mutually incompatible thickener-containing non-fluorine-based base oil and thickener-containing fluorine-based base oil, the thickener-containing base oils being in a morphological structure, where one of the base oils is homogeneously dispersed in a particulate state in the other thickener-containing base oil.

The morphological structure can include, in a broad sense, a coagulation state, etc. of molecules in polymer alloy such as polymer blends in the case of amorphous polymers, block copolymers, etc., but in the present invention it is restricted to a structure of one of thickener-containing base oils being homogeneously dispersed in a particulate state as a dispersed phase in the other thickener-containing oil as a continuous phase, i.e. in a sea-island structure state.

One of the thickener-containing base oils as dispersed in the particulate state as a dispersed phase is such that the thickener-containing base oil in the particulate state having an average particle size of not more than 30 μm, preferably not more than 20 μm, more preferably not more than 10 μm, and is dispersed in a volumic ratio of not less than 50%, preferably not less than 75%, more preferably not less than 90%, of total particles of the dispersed phase. The volumic ratio can be calculated by measuring total area of particles observed on a microscopic picture, calculating an area proportion of the particles in the observed surface, and raising the area proportion to the power of 3/2.

Such a state that one thickener-containing base oil as the dispersed phase is homogeneously dispersed in a particulate state in the other thickener-containing base oil as the continuous phase, i.e. the dispersion state in a morphological structure, can be established only by conducting a kneading operation through a three-roll mill at least twice, whereby a grease composition comprising a mixture of the non-fluorine-based grease and the fluorine-based grease can be obtained. In other words, such a kneaded state cannot be obtained even by conducting the kneading operation only once, or even by conducting the kneading operation through a high pressure homogenizer at least twice.

Not only the homogeneous appearance, but also uniform lubricating effect can be obtained from any sampled portions of the grease composition, by homogeneous dispersion of mutually incompatible non-fluorine-based grease and fluorine-based grease. The homogenization is extended even to tiny microscopic portions, and thus oil separation can be suppressed even if heated, and also distinguished heat resistance can be obtained. Furthermore, softening is hard to take place, even if exposed to a shearing force, and thus prolonged life of the grease composition, distinguished abrasion resistance against the mating members, and lower and stable friction coefficient can be obtained. That is, energy saving and higher precision of machinery using the grease can be attained.

EXAMPLES

The present invention will be described in detail below, referring to Examples.

Examples 1 to 10

Grease A (non-fluorine-based grease): Prepared by mixing trimellitic acid ester oil (kinematic viscosity at 40° C.: 100 $mm^2$/sec.) containing 2 wt. % of an amine-based antioxidant with an aliphatic diurea compound as a thickener in a proportion of 10 vol. % in the base grease, followed by kneading through a three-roll mill twice Grease B (non-fluorine-based grease): Prepared by mixing poly-α-olefin oil (kinematic viscosity at 40° C.: 30 $mm^2$/sec.) containing 2 wt. % of an amine-based antioxidant with barium complex soap as a thickener in a proportion of 30 vol. % in the base grease, followed by kneading through a three-roll mill twice Grease C (fluorine-based grease): Prepared by mixing a base oil having a molecular structure represented by:

$$RfO[CF(CF_3)CF_2O]_mRf$$

and having a kinematic viscosity at 40° C. of 230 $mm^2$/sec. with PTFE powders (average particle size: 0.3 μm) as a thickener in a proportion of 30 vol. % in the base grease, followed by kneading through a three-roll mill twice Grease D (fluorine-based grease): Prepared by mixing a base oil having a molecular structure represented by:

$$RfO(CF_2CF_2O)_m(CF_2O)_nRf$$

and having a kinematic viscosity at 40° C. of 150 $mm^2$/sec. with PTFE powders (average particle size: 0.3 μm) as a thickener in a proportion of 30 vol. % in the base grease, followed by kneading through a three-roll mill twice The above-mentioned non-fluorine-based greases (greases A or B) and fluorine-based greases (greases C or D) were mixed together in given volumic ratios, and the mixtures were thoroughly mixed with stirring in a mixing kettle at 30° C. for 60 minutes, followed by kneading through a three-roll mill twice under roll clamping pressure of 10 kgf/$cm^2$ (=0.98 MPa).

The resulting grease compositions were subjected to evaluation or determination of the following test items

- Appearance: by visual observation; homogeneous one was evaluated as ○, whereas heterogeneous one as x
- Particle size: by observing the particle sizes of dispersed particles with a microscope (magnification: ×600, or ×1,500), followed by photographing, where the largest size of the particles on the picture was regarded as particle size
- Heat resistance (degree of oil separation): by determining a degree of oil separation (wt. %) after heating at 180° for 24 hours, according to JIS K2220.11 corresponding to ASTM D6184-98 (the smaller the degree, the better)
- Shearing stability (change in consistency): by rotating a grease-filled cylinder at 80° C. and 165 rpm for 24 hours in a Shell roll test, and determining a change in consistency before and after the test, according to ASTM D183 (the smaller the change, the better)
- Friction coefficient: by placing a cylindrical column, 5 mm in diameter and 10 mm in height, onto a flat plate, and rotating the flat plate under following conditions; temperature room temperature, rotating speed: 1 m/sec., load: 9.8N, material: SUS304, and sliding state: surface contact, to determine a friction coefficient (the smaller the coefficient, the better)
- Abrasion characteristics (abrasion trace size): by conducting a Shell four ball test by rotating under following conditions; temperature: 75° C., rotation speed: 1,200 rpm, load 392N, and time: 60 minutes, according to ASTM D2266, to determine an abrasion trace size (the smaller the trace size, the better)

Comparative Examples 1 to 6

The non-fluorine-based greases (greases A or B) and the fluorine-based grease (grease C) were mixed together in given volumic ratios, and the mixtures were thoroughly mixed with stirring in a mixing kettle at 30° C. for 60 minutes, followed by kneading through a high pressure homogenizer (100 bars) once (Comparative Examples 1 to 5) or twice (Comparative Example 6).

Comparative Example 7

In Example 7, the run number of three-roll mill kneading operation was changed to one.

Figure 2:
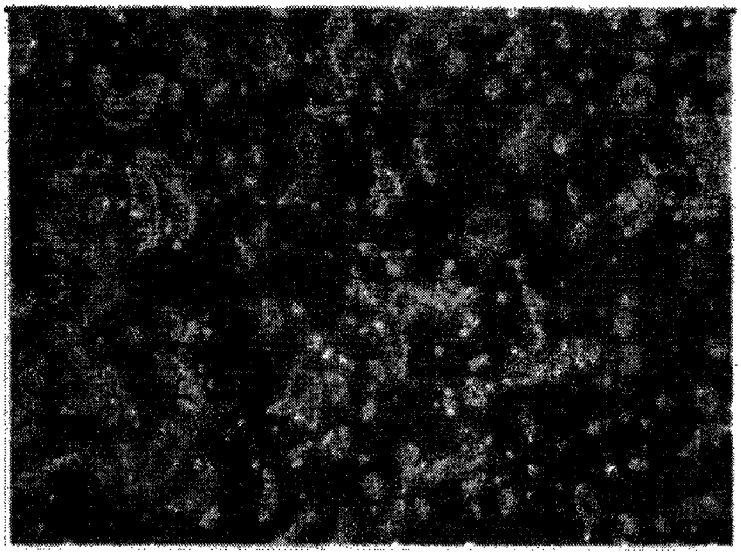

The results obtained in the foregoing Examples and Comparative Examples are shown in the following Table together with volumic proportions of thickeners in total (thickener ratios). The appearances of all the Examples were evaluated to be ○, whereas those of all the Comparative Examples as x. FIG. 1 is a microscopic picture (magnification: ×600) of grease composition obtained in Example 7, and FIG. 2 is that of grease composition obtained in Comparative Example 1 (magnification: ×600).

TABLE

| | Grease (Vol. %) | | | | Thickener ratio | Particle size | Degree of oil separation | Change in | Friction | Abrasion trace size |
|---|---|---|---|---|---|---|---|---|---|---|
| | A | B | C | D | (vol. %) | (μm) | (wt. %) | consistency | coefficient | (mm) |
| Ex. | | | | | | | | | | |
| Ex. 1 | 93 | — | 7 | — | 16 | 5 | 0.5 | 48 | 0.04 | 0.3 |
| Ex. 2 | 75 | — | 25 | — | 19 | 10 | 0.7 | 48 | 0.04 | 0.4 |
| Ex. 3 | 25 | — | 75 | — | 27 | 10 | 0.9 | 32 | 0.05 | 0.6 |
| Ex. 4 | — | 25 | 75 | — | 27 | 10 | 0.7 | 30 | 0.05 | 0.6 |
| Ex. 5 | — | 50 | 50 | — | 32 | 10 | 0.4 | 32 | 0.05 | 0.3 |
| Ex. 6 | — | 42 | 58 | — | 32 | 10 | 0.3 | 28 | 0.05 | 0.3 |
| Ex. 7 | 75 | — | 25 | — | 21 | 20 | 0.7 | 41 | 0.04 | 0.5 |
| Ex. 8 | 60 | — | — | 40 | 21 | 20 | 0.9 | 45 | 0.03 | 0.6 |
| Ex. 9 | 37 | — | 63 | — | 15 | 20 | 1.1 | 41 | 0.05 | 0.4 |
| Ex. 10 | — | 60 | 40 | — | 21 | 25 | 0.9 | 38 | 0.04 | 0.4 |
| Comp. | | | | | | | | | | |
| Ex. 1 | 75 | — | 25 | — | 21 | 35 | 1.5 | 55 | 0.06 | 0.7 |
| Ex. 2 | — | 42 | 58 | — | 29 | 40 | 2.8 | 57 | 0.07 | 0.8 |
| Ex. 3 | 53 | — | 47 | — | 22 | 50 | 1.7 | 68 | 0.06 | 0.7 |
| Ex. 4 | — | 50 | 50 | — | 20 | 50 | 2.5 | 60 | 0.08 | 0.7 |
| Ex. 5 | 50 | — | 50 | — | 23 | 60 | 2.0 | 62 | 0.07 | 0.8 |
| Ex. 6 | 75 | — | 25 | — | 21 | 35 | 1.4 | 55 | 0.06 | 0.7 |
| Ex. 7 | 75 | — | 25 | — | 21 | 35 | 1.2 | 50 | 0.06 | 0.7 |

INDUSTRIAL UTILITY

The present grease composition having the above-mentioned characteristics can be suitably used for lubrication and protection of contact parts between sliding members of, e.g. ball-and-roller bearings, plain bearings, sintered bearings, gears, valves, cocks, oil seals, electric contacts, etc., or parts requiring abrasion resistance or shearing stability, though the heat resistance is not so much required.

More specifically, the present grease composition is suitable for use in the various parts of the following machinery, machines and apparatuses:

In the case of automobiles, ball-and-roller bearings, plain bearings, gear parts requiring a heat resistance and a shearing stability such as electrically driven radiator fan motors, fan couplings, electrically controlled EGRs, electronically controlled throttle valves, alternators, idler pulleys, electrically driven brakes, hub units, water pumps, power windows, wipers, electrically-driven power steerings, etc.

electric contact parts requiring a heat resistance, a shearing stability, and an abrasion resistance, such as automatic transmission control switches, lever control switches, push switches, etc.

rubber seal parts, requiring a heat resistance and a shearing stability, such as X ring parts of viscous couplings, O rings of exhauster brakes, etc. ball-and-roller bearings, plain bearings, gears, sliding parts, etc. of head lights, seats, ABS, door locks, door hinges, clutch boosters, 2-partitioned fly wheels, window regulators, ball joints, clutch boosters, etc.

In the case of business machines, ball-and-roller bearings, plain bearings, sliding parts of resin films, or gear parts, etc., requiring a heat resistance and an abrasion resistance, such as fixing rolls, fixing belts, etc., of copying machines, laser beam printers, etc In the case of resin processing machinery, ball-and-roller bearings, plain bearings, pins, oil seals, gears, etc., requiring a heat resistance and a load resistance, such as film tenters, film laminaters, and Banbury mixers In the case of paper-making machinery, ball-and-roller bearings, plain bearings, pins, oil seals, gears, etc., in corrugating machines, requiring a heat resistance and an abrasion resistance In the case of wood processing machinery in conch presses, ball-and-roller bearings, plain bearings, pins, oil seals, gears, etc., requiring a heat resistance and an abrasion resistance In the case of food making machinery, linear guides of baking equipment, oven, etc., ball-and-roller bearings, etc., requiring a heat resistance and an abrasion resistance In spindles, servomotors, etc. of machine tools, ball-and-roller bearings, plain bearings, etc., requiring a low friction coefficient Sliding parts, etc. of hinges of mobile telephones, requiring a shearing stability and an abrasion resistance Ball-and-roller bearings, and gears in vacuum pumps in semiconductor production units, liquid crystal production units, electron microscopes, etc., and ball-and-roller bearings, etc. of breakers in electronically-regulated units In domestic electric•information machines, ball-and-roller bearings, plain bearings, oil seals, etc. of personal computer cooling fans, vacuum cleaners, washing machines, etc

The invention claimed is:

1. A grease composition produced by a process which comprises kneading a mutually incompatible mixture of 25-95 vol. % of a thickener-containing non-fluorine-based base oil comprising at least one of ester-based synthetic oils and synthetic hydrocarbon oils as the base oil and at least one of metallic soaps, metallic complex soaps and urea-based compounds as the thickener, and 75-5 vol. % of a thickener-containing fluorine-based base oil comprising a perfluoropolyether represented by the general formula:

$$RfO[CF(CF_3)CF_2O]_sRf$$

where Rf is perfluoro lower alkyl groups having 1-5 carbon atoms, s=2-200, as the base oil and fluororesins as the thickener, the proportion of thickeners in total being in a range of more than 30 vol. % to not more than 50 vol. % in the composition, through a three-roller mill at least twice, wherein the base oils are in a morphological structure and where one of the base oils is homogeneously dispersed in a particulate state in an average particle size of not more than 30 μm as a dispersed phase in a sea-island structure in the other base oil in a continuous phase.

2. A grease composition produced by a process which comprises kneading a mutually incompatible mixture of 25-40 vol. % or 55-95 vol. % of a thickener-containing non-fluorine-based base oil comprising at least one of ester-based synthetic oils and synthetic hydrocarbon oils as the base oil and at least one of metallic soaps, metallic complex soaps and urea-based compounds as the thickener, and 75-60 vol. % or 45-5 vol. % of a thickener-containing fluorine-containing base oil comprising a perfluoropolyether represented by the general formula:

$$RfO[CF(CF_3)CF_2O]_sRf$$

where Rf is perfluoro lower alkyl groups having 1-5 carbon atoms, s=2-200, as the base oil and fluororesins as the thickener, the proportion of thickeners in total being in a range of 10-30 vol. % in the composition, through a three-roll mill at least twice, wherein the base oils are in a morphological structure where one of the base oils is homogeneously dispersed in a particulate state in an average particle size of not more than 30 μm as a dispersed phase in a sea-island structure in the other base oil in a continuous phase.

3. A process for producing a grease composition according to claim 1, wherein the process comprises kneading a mutually incompatible mixture of 25-95 vol. % of a thickener-containing non-fluorine-based base oil comprising at least one of ester-based synthetic oils and synthetic hydrocarbon oils as the base oil and at least one of metallic soaps, metallic complex soaps and urea-based compounds as the thickener, and 75-5 vol. % of a thickener-containing fluorine-based base oil comprising a perfluoropolyether represented by the general formula:

$$RfO[CF(CF_3)CF_2O]_sRf$$

where Rf is perfluoro lower alkyl groups having 1-5 carbon atoms, s=2-200, as the base oil and fluororesins as the thickener, the proportion of thickeners in total being in a range of more than 30 vol. % to not more than 50 vol. % in the composition, through a three-roller mill at least twice at a roll clamping pressure of 0.2 to 7 MPa.

4. A process for producing a grease composition according to claim 2, wherein the process comprises kneading a mutually incompatible mixture of 25-40 vol. % or 55-95 vol. % of a thickener-containing non-fluorine-based base oil comprising at least one of ester-based synthetic oils and synthetic hydrocarbon oils as the base oil and at least one of metallic soaps, metallic complex soaps and urea-based compounds as the thickener, and 75-60 vol. % or 45-5 vol. % of a thickener-containing fluorine-containing base oil comprising a perfluoropolyether represented by the general formula:

$$RfO[CF(CF_3)CF_2O]_sRf$$

where Rf is perfluoro lower alkyl groups having 1-5 carbon atoms, s=2-200, as the base oil and fluororesins as the thickener, the proportion of thickeners in total being in a range of 10-30 vol. % in the composition, through a three-roll mill at least twice at a roll clamping pressure of 0.2 to 7 MPa.

* * * * *